US008708845B2

(12) United States Patent
Chuang et al.

(10) Patent No.: US 8,708,845 B2
(45) Date of Patent: Apr. 29, 2014

(54) BALL BAT INCLUDING MULTIPLE FAILURE PLANES

(75) Inventors: Hsing-Yen Chuang, Simi Valley, CA (US); Dewey Chauvin, Simi Valley, CA (US)

(73) Assignee: Easton Sports, Inc., Van Nuys, CA (US)

( * ) Notice: Subject to any disclaimer, the term of this patent is extended or adjusted under 35 U.S.C. 154(b) by 75 days.

(21) Appl. No.: 13/337,630

(22) Filed: Dec. 27, 2011

(65) Prior Publication Data

US 2012/0142461 A1 Jun. 7, 2012

Related U.S. Application Data

(63) Continuation-in-part of application No. 12/652,523, filed on Jan. 5, 2010, now Pat. No. 8,182,377.

(51) Int. Cl.
*A63B 59/06* (2006.01)

(52) U.S. Cl.
USPC ..... 473/567

(58) Field of Classification Search
USPC ..... 473/457, 519, 520, 564–568
See application file for complete search history.

(56) References Cited

U.S. PATENT DOCUMENTS

| | | | |
|---|---|---|---|
| 4,014,542 | A | 3/1977 | Tanikawa |
| 4,025,377 | A | 5/1977 | Tanikawa |
| 4,132,130 | A | 1/1979 | Schneider |
| 4,150,291 | A | 4/1979 | Gulley |
| 4,505,479 | A | 3/1985 | Souders |
| 4,604,319 | A | 8/1986 | Evans et al. |
| 4,804,315 | A | 2/1989 | Ferris et al. |
| 4,818,584 | A | 4/1989 | Eisenmann |
| 4,848,745 | A | 7/1989 | Bohannan et al. |
| 4,867,399 | A | 9/1989 | Therond |
| 4,963,408 | A | 10/1990 | Huegli |
| 5,048,441 | A | 9/1991 | Quigley |
| 5,057,353 | A | 10/1991 | Maranci et al. |
| 5,301,940 | A | 4/1994 | Seki et al. |
| 5,395,108 | A | 3/1995 | Souders et al. |
| 5,415,398 | A | 5/1995 | Eggiman |
| RE35,081 | E | 11/1995 | Quigley |
| 5,556,695 | A | 9/1996 | Mazelsky |
| 5,641,366 | A | 6/1997 | Hohman |
| 5,676,610 | A | 10/1997 | Bhatt et al. |
| 6,033,758 | A | 3/2000 | Kocher et al. |
| 6,042,493 | A | 3/2000 | Chauvin et al. |
| 6,053,828 | A | 4/2000 | Pitsenberger |

(Continued)

FOREIGN PATENT DOCUMENTS

WO 2006015160 A1 9/2006

OTHER PUBLICATIONS

United States Patent and Trademark Office, Search Report and Written Opinion for PCT/US2012/069268, mailed Apr. 15, 2013.

(Continued)

*Primary Examiner* — Mark Graham
(74) *Attorney, Agent, or Firm* — Perkins Coie LLP

(57) ABSTRACT

A composite ball bat includes multiple failure planes within a barrel wall. By including multiple failure planes in a barrel wall, the bat exhibits a drop in performance when subjected to rolling or other extreme deflection, with no temporary increase in barrel performance. Because the barrel performance does not increase, the ball bat is able to comply with performance limitations imposed by regulatory associations.

7 Claims, 4 Drawing Sheets

(56) References Cited

U.S. PATENT DOCUMENTS

| | | | | |
|---|---|---|---|---|
| 6,265,333 | B1 | 7/2001 | Dzenis et al. | |
| 6,287,222 | B1 | 9/2001 | Pitsenberger | |
| 6,425,836 | B1 | 7/2002 | Misono et al. | |
| 6,634,969 | B2 | 10/2003 | Forsythe et al. | |
| 6,723,012 | B1 | 4/2004 | Sutherland | |
| 6,723,127 | B2 | 4/2004 | Ralph et al. | |
| 6,755,757 | B2 | 6/2004 | Sutherland | |
| 6,761,653 | B1 | 7/2004 | Higginbotham et al. | |
| 6,808,464 | B1 | 10/2004 | Nguyen | |
| 6,866,598 | B2 | 3/2005 | Giannetti et al. | |
| 6,997,826 | B2 | 2/2006 | Sutherland | |
| 7,006,947 | B2 | 2/2006 | Tryon, III et al. | |
| 7,087,296 | B2 | 8/2006 | Porter | |
| 7,163,475 | B2 | 1/2007 | Giannetti | |
| 7,585,235 | B2 | 9/2009 | Misono et al. | |
| 7,699,725 | B2 | 4/2010 | McNamee et al. | |
| 7,857,719 | B2 | 12/2010 | Giannetti et al. | |
| 7,874,946 | B2 | 1/2011 | Smith | |
| 2002/0098924 | A1 | 7/2002 | Houser et al. | |
| 2003/0153416 | A1 | 8/2003 | Anderson | |
| 2004/0132563 | A1 | 7/2004 | Giannetti et al. | |
| 2004/0176197 | A1 | 9/2004 | Sutherland | |
| 2004/0209716 | A1 | 10/2004 | Vacek et al. | |
| 2005/0143203 | A1 | 6/2005 | Souders et al. | |
| 2006/0247078 | A1* | 11/2006 | Giannetti et al. | 473/564 |
| 2006/0247079 | A1 | 11/2006 | Sutherland et al. | |
| 2007/0202974 | A1 | 8/2007 | Giannetti | |
| 2007/0205201 | A1 | 9/2007 | Cundiff et al. | |
| 2009/0065299 | A1 | 3/2009 | Vito et al. | |
| 2009/0181813 | A1 | 7/2009 | Giannetti et al. | |
| 2009/0215560 | A1* | 8/2009 | McNamee et al. | 473/567 |
| 2010/0160095 | A1 | 6/2010 | Chauvin et al. | |
| 2011/0165976 | A1 | 7/2011 | Chuang et al. | |
| 2011/0287875 | A1 | 11/2011 | Vander Pol et al. | |

OTHER PUBLICATIONS

United States Patent and Trademark Office, Search Report and Written Opinion for PCT/US10/62083, mailed Apr. 6, 2011.

* cited by examiner

| | Constant Angle Material Design | | | Durable Design | | | Multiple Failure Plane Design | | |
|---|---|---|---|---|---|---|---|---|---|
| Ply No. | Fiber Angle | Material | Shear Stress (psi) | Fiber Angle | Material | Shear Stress (psi) | Fiber Angle | Material | Shear Stress (psi) |
| 1 | 30 | Carbon | - | 60 | Carbon | - | 60 | Carbon | - |
| 2 | 30 | Carbon | 28.1 | 60 | Glass | 8.8 | 60 | Glass | 5.5 |
| 3 | 30 | Carbon | 51.9 | 60 | Glass | 16.3 | 60 | Glass | 10.2 |
| 4 | 30 | Carbon | 71.3 | 30 | Glass | 37.6 | 0 | Carbon | 166.6 |
| 5 | 30 | Carbon | 85.9 | 30 | Glass | 45.5 | 30 | Glass | 30.3 |
| 6 | 30 | Carbon | 95.7 | 30 | Glass | 51.0 | 30 | Glass | 33.8 |
| 7 | 30 | Carbon | 100.5 | 0 | Carbon | 355.7 | 0 | Carbon | 236.4 |
| 8 | 30 | Carbon | 85.7 | 30 | Glass | 43.1 | 30 | Glass | 25.9 |
| 9 | 30 | Carbon | 79.9 | 30 | Glass | 40.0 | 30 | Glass | 24.5 |
| 10 | 30 | Carbon | 68.5 | 60 | Glass | 20.4 | 0 | Carbon | 132.3 |
| 11 | 30 | Carbon | 51.6 | 60 | Glass | 15.3 | 60 | Glass | 9.0 |
| 12 | 30 | Carbon | 28.8 | 60 | Glass | 8.5 | 60 | Glass | 5.0 |
| 13 | 30 | Carbon | - | 60 | Glass | - | 60 | Glass | - |

Fig. 3

| | | ABI Roll 1 | ABI Roll 2 | ABI Roll 3 |
|---|---|---|---|---|
| | | 0.100" | 0.113" | 0.125" |
| | BESR 1 | BESR 2 | BESR 3 | BESR 4 |
| Durable | 0.722 | 0.722 | 0.739 Failed test | - |
| Multiplane | 0.72 | 0.72 | 0.714 | No longer Testable |

Fig. 4

BALL BAT INCLUDING MULTIPLE FAILURE PLANES

PRIORITY CLAIM

This application is a Continuation-in-Part of U.S. patent application Ser. No. 12/652,523, filed Jan. 5, 2010, and now pending.

BACKGROUND

Softball and baseball leagues have experienced a dramatic increase in the number of bats being altered by players to enhance hitting performance. The most common method for altering a bat to increase performance is a practice known as "rolling," in which the bat barrel is placed between two cylinders ("rollers") that are oriented perpendicularly to the longitudinal axis of the barrel. The rollers are compressed into the bat barrel, which deflects the bat cross section. (A schematic diagram of a rolling setup is shown in FIG. 2.) While the barrel is in the compressed mode, the bat is moved along its longitudinal axis through the compression rollers to compress the barrel along most of its length. This rolling is typically repeated at least 10 times and is generally performed approximately every 45° around the barrel's circumference.

To obtain increased performance, players generally repeat the rolling process at a deflection significant enough to break down the shear strength between plies in the barrel, which severely alters the barrel kinetics. The mechanism by which this is achieved is generally referred to as accelerated break-in ("ABI").

Methods to induce ABI generally target the weak interlaminar region of the composite structure, which leads to interlaminar fracture or delamination. Delamination is a mode of failure that causes composite layers within a structure to separate, resulting in significantly reduced mechanical toughness of the composite structure. The strength at which a composite structure fails by delamination is commonly referred to as its interlaminar shear strength. Delamination typically occurs at or near the neutral axis of the barrel laminate and serves to lower the barrel compression of the bat, which increases barrel flex and "trampoline effect" (i.e., barrel performance). While following this procedure shortens the bat life, players commonly elect a temporary increase in performance over durability.

For many softball bats, approximately 0.20 inches or more of ABI rolling deflection may be required before the barrel initially fails and performance increases. The actual amount of deflection required depends upon the overall durability of the barrel design: the more durable the barrel design, the more deflection the barrel can withstand without performance increases. Less durable laminate designs, conversely, may only withstand approximately 0.10 inches of deflection, for example, before barrel performance increases.

To help prevent the use of impermissibly altered bats, the Amateur Softball Association ("ASA") has implemented a new test method that requires all softball bats to comply with performance limits even after the bats are rolled an unlimited number of times. The ASA requires a bat to remain below a chosen performance limit (currently 98 mph when tested per ASTM F2219) or break during the test. Sufficient breakage of the bat needs to be notable by the players or umpires on the field.

The NCAA has recently adopted a similar ABI protocol for composite baseball bats. The protocol uses ASTM F2219 to measure the performance level of the bat calculated as bat-ball coefficient of restitution ("BBCOR"). This protocol requires rolling of a bat to test for performance increases that might occur when a bat is overstressed or damaged. The BBCOR and barrel compression are tested when the bat is new and undamaged. If the bat tests below the established performance limit, the bat is then subjected to rolling. If the barrel compression changes by at least 15%, the bat BBCOR is retested. If the barrel compression does not change by 10%, the bat is rolled again with the deflection increased by 0.0125". This cycle is repeated until a bat exceeds the performance limit or passes the protocol. To pass the protocol, a bat must show a decrease of a least 0.014 in ball exit speed ratio ("BESR") or 0.018 in BBCOR, or the bat must break to a point where testing the bat can no longer provide a measurable rebound speed.

The dramatic increase in players altering bats has forced associations to test composite bats all the way through failure to assure they do not exceed performance limits at any time. With this turn of events, the focus of bat design must adapt.

SUMMARY

A composite ball bat includes multiple failure planes within a barrel wall. By including multiple failure planes in a barrel wall, the bat exhibits a drop in performance when subjected to rolling or other extreme deflection, with no temporary increase in barrel performance. Because the barrel performance does not increase, the ball bat is able to comply with performance limitations imposed by regulatory associations.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views:

FIG. 3 is a table comparing the shear stress properties of three alternative composite ball bat designs.

FIG. 4 is a table comparing BESR test results of a durable bat design and a multiple failure plane bat design.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
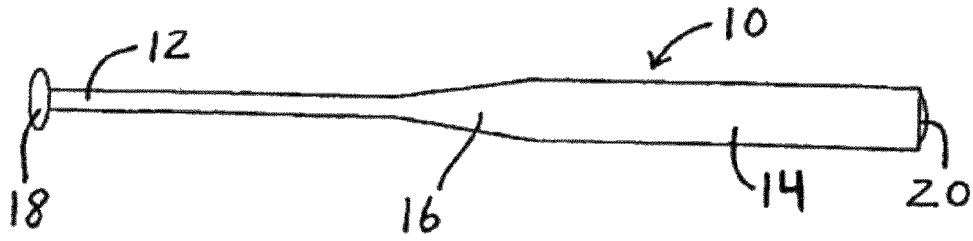
FIG. 1 is a perspective view of a ball bat, according to one embodiment.

Turning now in detail to the drawings, as shown in FIG. 1, as shown in FIG. 1, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow, allowing the bat 10 to be relatively lightweight so that ball players may generate substantial bat speed when swinging the bat 10. The ball bat 10 may be a one-piece construction or may include two or more separate attached pieces (e.g., a separate handle and barrel), as described, for example, in U.S. Pat. No. 5,593,158, which is incorporated herein by reference.

The bat barrel 14 preferably is constructed from one or more composite materials that are co-cured during the barrel molding process. Some examples of suitable composite materials include plies reinforced with fibers of carbon, glass; graphite, boron, aramid, ceramic, Kevlar, or Astroquartz®. The bat handle 12 may be constructed from the same material as, or different materials than, the barrel 14. In a two-piece ball bat, for example, the handle 12 may be constructed from a composite material (the same or a different material than that used to construct the barrel), a metal material, or any other suitable material.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference. An ISCZ may include, for example, a disbonding layer or other element, mechanism, or space suitable for preventing transfer of shear stresses between neighboring barrel walls. A disbonding layer or other ISCZ preferably further prevents neighboring barrel walls from bonding to each other during curing of, and throughout the life of, the ball bat 10.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

Figure 2:
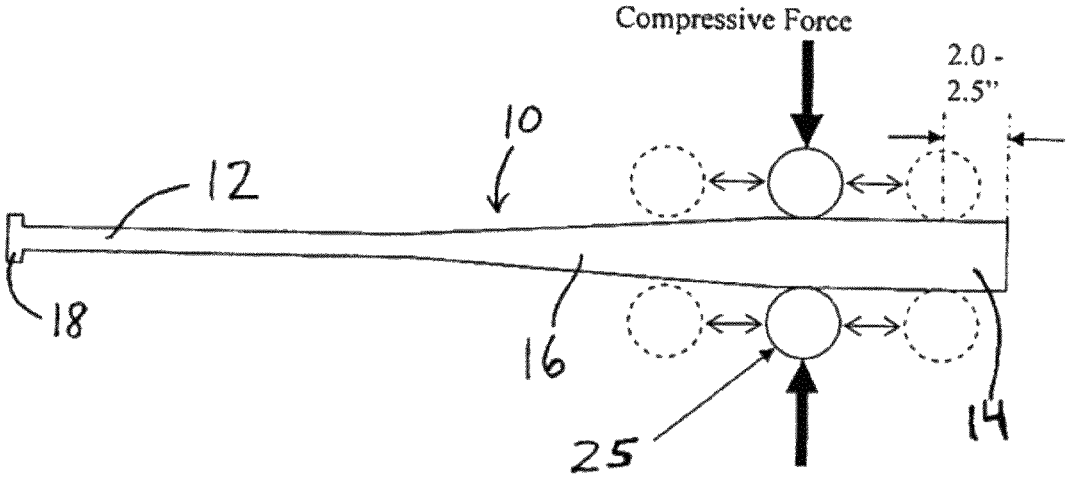
FIG. 2 is a schematic diagram of a ball bat being compressed in a rolling apparatus.
Figure 5A:
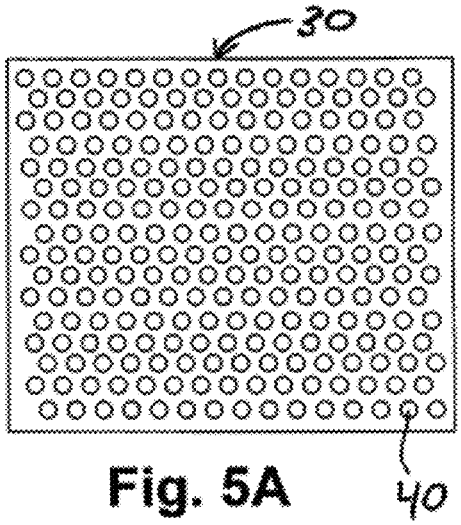
FIGS. 5A-5D are perspective views of four embodiments of a perforated partial barrier layer that may be included between composite plies in a ball bat.
Figure 5B:
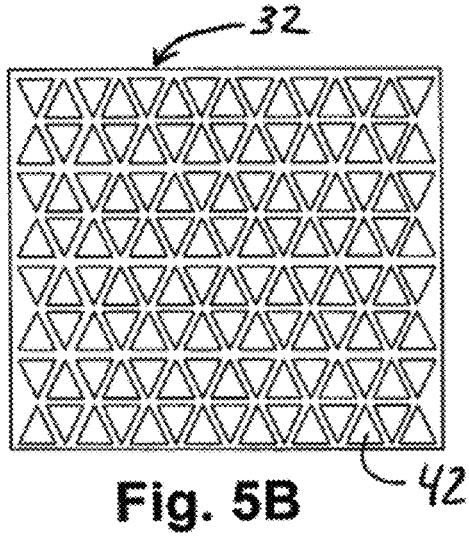
Figure 5C:
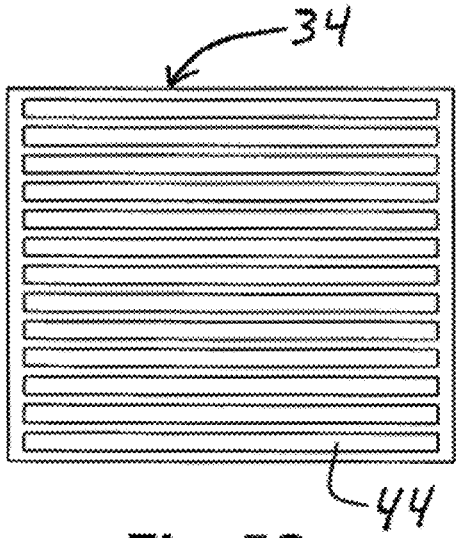
Figure 5D:
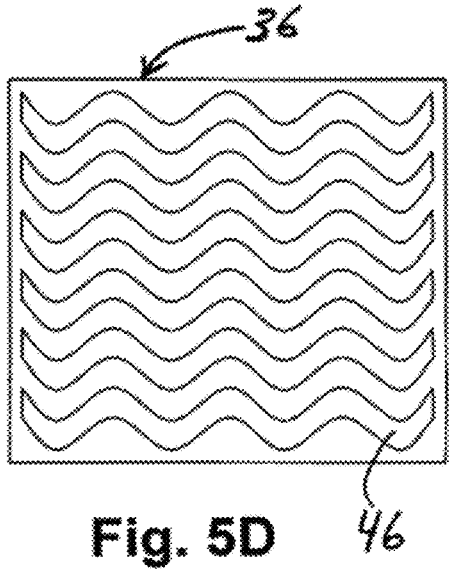

FIG. 2 schematically illustrates a rolling apparatus in which rollers 25 are used to compress a bat barrel 14 along its longitudinal axis from a location approximately 2.0-2.5 inches from the end of the ball bat 10 to the tapered section 16 of the ball bat 10. As explained above, when a bat barrel is deflected to the point of failure, as a result of rolling or another deflection-inducing stimulus, delamination typically occurs between plies located at or near the neutral axis of the barrel 14. In a single wall bat, a single neutral axis, which is defined as the centroid axis about which all deformation occurs, is present. The shear stress in the barrel wall is generally at a maximum along this neutral axis. In a multi-wall bat, an independent neutral axis is present in each barrel wall.

The radial location of the neutral axis in a barrel wall varies according to the distribution of the composite layers and the stiffness of the specific layers. If a barrel wall is made up of homogeneous, isotropic layers, the neutral axis will be located at the radial midpoint of the wall. If more than one composite material is used in a wall, or if the material is not uniformly distributed, the neutral axis may reside at a different radial location, as understood by those skilled in the art. For purposes of the embodiments described herein, the neutral axis of a given barrel wall will generally be assumed to be at or near the radial midpoint of the barrel wall.

A failure location where delamination occurs between composite plies, such as the location at or near a neutral axis, will generally be referred to herein as a failure plane. To prevent the increase in barrel compliance, and thus barrel performance, which generally occurs when delamination is induced in a composite ball bat, at least one additional failure plane is created or provided in the barrel wall of the ball bats described herein.

In a single-wall bat, at least one additional failure plane is provided in the single barrel wall. In a multi-wall bat, in which each wall includes its own neutral axis, an additional failure plane is provided in at least one of the barrel walls. In a double-wall bat, for example, at least one additional failure plane may be provided in at least one of the barrel walls, and optionally within both of the barrel walls. For ease of description, a single-wall bat generally will be described throughout the remainder of this detailed description.

The inclusion of one or more additional failure planes in a barrel wall causes the barrel to fail simultaneously, or nearly simultaneously, at multiple locations when the barrel is subjected to rolling or other extreme deflection. This failure at multiple location yields a rapid drop in barrel performance significant enough that no temporary increase in barrel performance occurs. In a preferred embodiment, at least two additional failure planes, one on either side of the neutral axis, are provided within a given barrel wall.

For example, in one embodiment, additional failure planes may be located at approximately one-quarter and three-quarters the radial thickness (or at one-quarter and three-quarters the sectional and modulus moments of inertia) of the barrel wall, measured from the exterior surface of the barrel 14. Accordingly, assuming the barrel's neutral axis is located approximately at the radial midpoint of the barrel wall, failure planes are located at approximately one-quarter, one-half, and three-quarters the radial thickness of the barrel 14. Providing the additional failure planes at these locations is preferable because after the barrel wall fails at its primary neutral axis, the barrel wall essentially momentarily becomes a double-wall structure, such that a neutral axis is present on either side of the failure location (which typically occurs approximately at the radial midpoint of each of the newly created walls, i.e., the one-quarter and three-quarters locations of the overall barrel wall).

Once failure occurs at the primary neutral axis, failure occurs simultaneously, or nearly simultaneously, at the additional failure planes. The one or more additional failure planes optionally may be located at other locations within the barrel laminate, as long as the barrel fails simultaneously, or nearly simultaneously, at the multiple failure planes when the barrel is subjected to rolling or other extreme deflection, such that the combined failure prevents any increase in barrel performance.

The additional failure planes may be created in a variety of ways. In one embodiment, a sharp discontinuity in modulus is provided between neighboring composite plies in the barrel laminate to create a failure plane. This discontinuity may be provided by significantly varying the fiber angles in neighboring plies, which results in a severe drop in barrel compression at these locations. For example, a ply including carbon fibers angled at zero degrees relative to the longitudinal axis of the ball bat may be located adjacent to a ply including glass fibers angled at 60° relative to the longitudinal axis of the ball bat. The carbon ply may optionally include low-strain carbon fibers, which are less ductile and have lower elongation (i.e., they are more brittle) than higher strain carbon fibers, and therefore provide more predictable failure. High modulus carbon fibers having less than 1% elongation, for example, may be used.

The table of FIG. 3 shows the shear stress distribution in the following three composite ball bats, each of which includes thirteen plies:

(1) a single failure plane, all-carbon bat having a uniform or constant fiber angle of 30° throughout the several plies;

(2) a single failure plane, durable, primarily glass bat having an exterior carbon ply (ply 1) and a central carbon ply (ply 7), with the plies having fiber angles varying between 0 and 60°, and with no changes in fiber angles between neighboring plies exceeding 30°; and (3) a multiple failure plane, primarily glass bat including two additional carbon plies (relative to the second bat) at plies 4 and 10 having fibers angled at 0°, with plies 3 and 11 having glass fibers angled at 60°.

As the table indicates, the sharp discontinuity in modulus resulting from the 60° fiber angle variation between plies 3 and 4 and plies 10 and 11 in the third bat significantly increases the shear stress in the laminate stack at those regions (to 166.6 psi and 132.3 psi, respectively) such that additional failure planes are created. Those skilled in the art will appreciate that other variations in fiber angles between neighboring plies (e.g., at least approximately 45°) may alternatively be used, depending on the materials used (e.g., if the fiber modulus varies greatly between the materials used in neighboring plies, the fiber angle variation would not need to be as extreme), the number of failure planes included in a given barrel wall, the specific test with which a bat is designed to comply, and so forth. A variation in fiber angles between neighboring plies of approximately 60° is preferred, however, as such a variation adequately creates an additional failure plane, while providing sufficient durability for the bat to hold up when used as intended (i.e., when not subjected to rolling or other extreme deflection).

The table of FIG. 4 compares the BESR of the second and third bats described above when subjected to ABI rolling at a variety of barrel deflections. As shown in the table, at 0.113 inches of deflection, the durable, second bat exhibited an increase in performance or BESR (such that the bat failed the BESR test), whereas the third bat including multiple failure planes exhibited a decrease in performance or BESR (such that it passed the BESR test). Thus, when subjected to ABI rolling, the multiple failure planes in the third bat caused a significant drop in barrel performance, whereas the performance of the more durable second bat increased beyond acceptable limits.

While some variation in fiber angles between neighboring composite plies in a bat barrel has been used in existing bat designs, the significant variations described herein would not have been used, or even contemplated, since the goals of conventional bat design were generally to increase bat performance and durability. By varying the fiber angles so significantly between neighboring composite plies in a barrel wall, conversely, the ball bats described herein have intentionally reduced durability (once the barrel is deflected to the point where the interlaminar shear stress causes delamination between the plies located at the primary neutral axis of the barrel wall) such that barrel performance will not exceed specified performance limitations.

In another embodiment, one or more partial barrier layers may be used to create additional failure planes in the bat barrel. A partial barrier layer prevents bonding between portions of neighboring composite plies such that the interlaminar shear strength between those plies is reduced. A partial barrier layer may be made of polytetrafluoroethylene, nylon, or any other material suitable for preventing bonding between portions of neighboring composite plies.

Contrary to conventional disbonding layers or release plies, which often are used to entirely, or nearly entirely, separate the walls of a multi-wall ball bat (as described, for example, in incorporated U.S. Pat. No. 7,115,054), a relatively large percentage of the partial barrier layer's area includes perforations or other openings such that meaningful bonding may occur between composite plies located on either side of the barrier layer.

FIGS. 5A-5D show exemplary embodiments of partial barrier layers 30, 32, 34, 36. Perforations 40, 42, 44, 46 or other openings are preferably included in up to approximately 85% of each barrier layer's total area, such that the bonding area between the composite plies on either side of the barrier layer is reduced by at least 15% (relative to embodiments including no partial barrier layers). Accordingly, the barrier layer prevents a substantial amount of bonding, and therefore lowers the interlaminar shear strength between the neighboring plies, but still allows the plies on either side of the barrier layer to bond over up to approximately 85% of the barrier layer's total area.

For a bat having sufficient durability under normal use conditions, perforations or other openings are preferably included in up to approximately 80-85% of the total area of the barrier layer such that sufficient bonding, and therefore sufficient durability, is provided to withstand normal playing conditions. In bats with lower overall durability that tend to fail under normal use conditions, conversely, perforations or other openings are preferably included in at least approximately 25% of the total area of the barrier layer, such that less bonding is provided and the interlaminar shear strength between the plies on either side of the partial barrier layer is reduced.

The inclusion of one or more partial barrier layers reduces the interlaminar shear strength between the composite plies on either side of the barrier layers, thus creating additional failure planes in the ball bat. Accordingly, when the bat barrel is subjected to rolling or other extreme deflection, the ball bat will fail simultaneously, or nearly simultaneously, at multiple failure planes, such that no temporary increase in barrel performance occurs. In one embodiment, two partial barrier layers including perforations or openings in up to approximately 85% of their areas are included at approximately one-quarter and three-quarters the radial thickness of a given barrel wall, such that failure will occur at three locations (approximately at the neutral axis and at the two additional failure planes) when the ball bat is subjected to rolling or other extreme deflection.

In some embodiments, a higher percentage of perforations or openings may be included in a partial barrier layer, particularly if several partial barrier layers are included in a given barrel wall. When two partial barrier layers are included, however, perforations or other openings are preferably included in up to approximately 85% of the barrier layer's area, since a reduction in bonding of at least 15% is generally sufficient to create a failure plane. Those skilled in the art will appreciate that the appropriate percentage of perforations or openings required to create a failure plane may depend on the composite materials used, variations in fiber angles between the partially bonded composite plies, other materials present in the barrel to reduce bonding between plies, and so forth.

In another embodiment, low shear strength materials, which have relatively low adhesion to composite matrix materials, may be included in the barrel laminate to produce one or more additional failure planes. For example, one or more plies of paper or dry fibers may be included to create a weak shear plane between two or more composite plies in the barrel. Materials that do not strongly bond to the resins in the composite plies may also be used to accomplish a reduction in shear strength. Examples of these materials include polypropylene, polyethylene, polyethylene terephthalate, olefins, Delrin®, nylon, polyvinyl chloride, and so forth. The inclusion of one or more plies of these low shear strength materials lowers the interlaminar shear strength between composite plies in the barrel, thus creating one or more additional failure planes.

In another embodiment, foreign materials or contaminants may be used to lower the interlaminar shear strength between neighboring composite plies in a barrel. A sufficient quantity of talc, platelets, silica, thermoplastic particles, dust, and so forth may be located between neighboring composite plies to reduce the bond strength between the plies, thus creating one or more additional failure planes in the barrel. Those skilled in the art will appreciate that the amount of foreign material required to create a failure plane may vary based on how much the selected material reduces the interlaminar shear strength of the laminate matrix. In one embodiment, an amount of foreign materials or contaminants sufficient to reduce the bonding area between neighboring composite plies by at least approximately 30% may be used to create a failure plane between the composite plies.

In another embodiment, barrel shells may be pre-molded then over-molded with laminate, typically using a resin transfer molding process. Layers bonded to the pre-molded shell typically will have a weaker bond than a laminate that is co-cured. Those skilled in the art will appreciate that this reduced interlaminar shear strength can be used to force a failure when used in conjunction with failure planes in other locations in surrounding shells or within the pre-molded shell.

Figure 6:
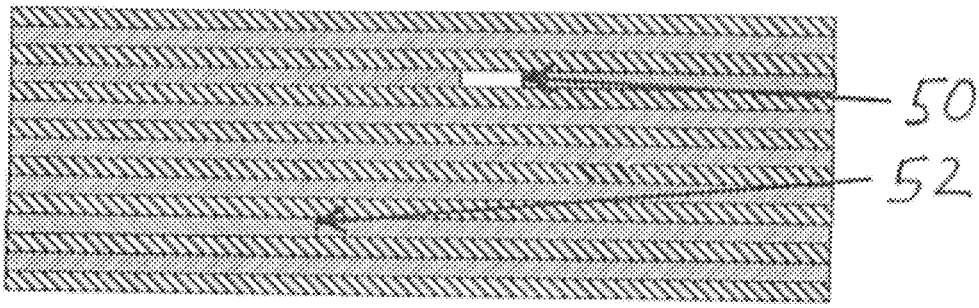
FIG. 6 is a sectional view of a portion of a bat barrel located near the tapered section of the ball bat including a gap and a butt joint in the barrel laminate, according to one embodiment.

FIG. 6 illustrates another embodiment in which one or more gaps 50 or butt joints 52 are positioned between longitudinally neighboring plies in the barrel 14 to create additional failure zones or failure planes. The gaps 50 or butt joints 52 preferably are located toward the tapered section 16 of the ball bat 10 but alternatively could be located closer to the sweet spot of the barrel 14, or closer to the free end of the barrel 14.

In the embodiment shown, a gap 50 is located approximately at one-quarter the radial thickness of the barrel wall, and a butt joint 52 is located approximately at three-quarters the radial thickness of the barrel wall. Depending on other features of the barrel laminate, the gap 50 or the butt joint 52 may optionally be located at other radial locations. In another embodiment, one or gaps 50 may be included without including a butt joint 52, or one or more butt joints may be included without including a gap 50. A gap 50 generally causes a greater degree of failure than does a butt joint 52.

Figure 7:
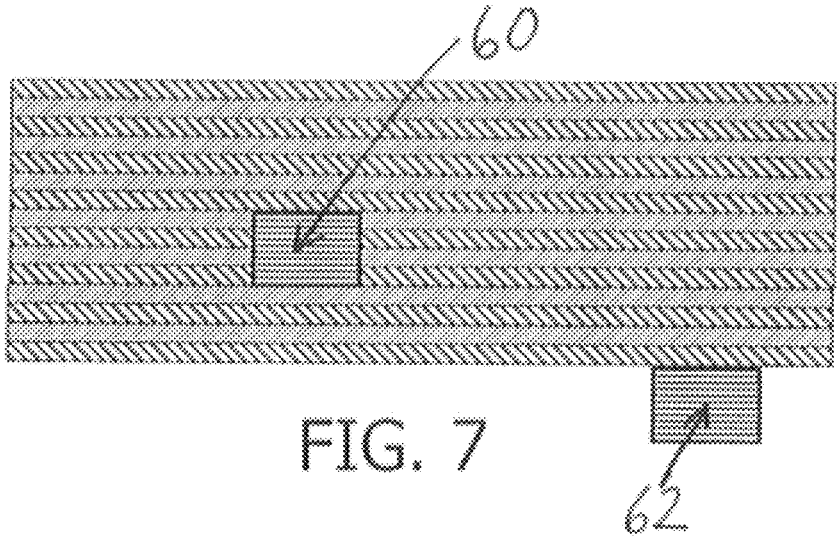
FIG. 7 is a sectional view of a portion of a bat barrel located near the tapered section of the ball bat including stiffening rings in the barrel laminate, according to one embodiment.

FIG. 7 illustrates another embodiment in which an annular stiffening ring 60 or other stiffening element is included within the barrel laminate. A stiffening ring 62 or other stiffening element may alternatively or additionally be included on or at the radially inner surface of the barrel 14. The one or more stiffening rings 60, 62 preferably are located toward the tapered section 16 of the ball bat 10 to lessen the affect on the bat's moment of inertia. Alternatively, the one or more stiffening rings 60, 62 may be located closer to the sweet spot of the barrel 14, or closer to the free end of the barrel 14.

The one or more stiffening rings may be pre-molded parts. For example, the rings may be made with carbon fibers and wrapped within the laminate stack of the barrel preform. Alternatively, the one or more stiffening rings may be co-molded with the barrel. The one or more rings could also be made of aluminum, steel, titanium, magnesium, a stiff plastic, or another material that is stiffer than the surrounding barrel laminate.

The inclusion of one or more such stiffening rings 60, 62 causes shear failure in the barrel laminate when the bat is subjected to rolling because stiffening rings limit localized barrel deflection. A roller just to the left or right of a stiffening ring 60, for example, would appreciably deflect the barrel in that region, while the stiffening ring 60 would prevent the barrel from deflecting in the region radially external to the stiffening ring 60. The lack of deflection in this region, combined with the significant deflection that occurs adjacent to the stiffening ring 60, causes a very high shear load through the thickness of the barrel wall. This high shear load creates an additional failure zone or failure plane within the barrel. In one embodiment, one or more stiffening rings may be combined with gaps, butt joints, or other failure-inducing features to provide more control of where the failures occur within the barrel wall.

Figure 8:
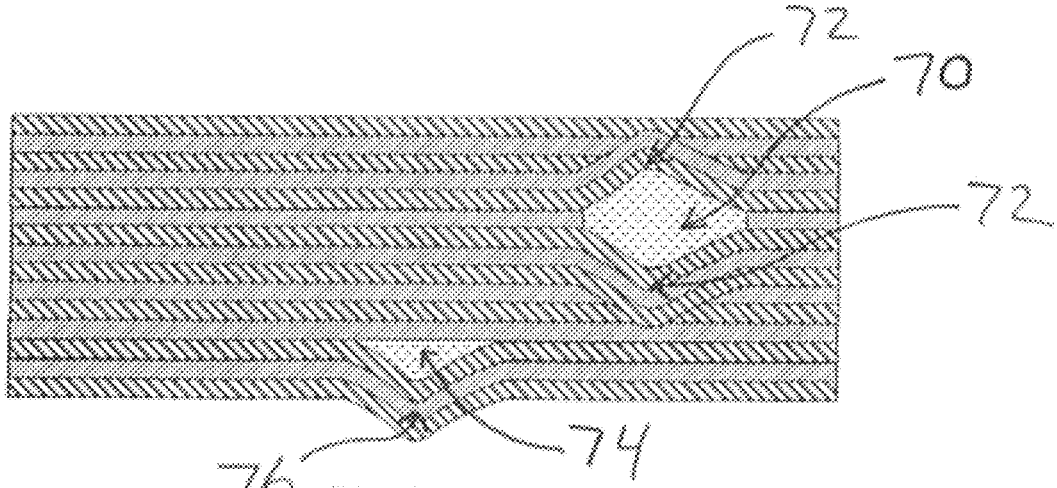
FIG. 8 is a sectional view of a portion of a bat barrel located near the tapered section of the ball bat including stiffening ribs in the barrel laminate, according to one embodiment.

FIG. 8 illustrates another embodiment in which a discontinuity in the barrel laminate creates a void 70 bordered by one or more stiffening ribs 72 or protrusions. The stiffening ribs 72 or protrusions constitute portions of the composite laminate that are shifted off of the longitudinal axis of the ball bat by the discontinuity. A similar discontinuity may alternatively or additionally be included near the radially inner surface of the barrel 14 to create a void 74 and a radially inwardly projecting stiffening rib 76 or protrusion.

The one or more stiffening ribs 72, 76 preferably are located toward the tapered section 16 of the ball bat 10 but could alternatively be located closer to the sweet spot of the barrel 14, or closer to the free end of the barrel 14. Similar to the stiffening ring embodiment of FIG. 7, the inclusion of one or more stiffening ribs 70, 74 causes shear failure in the barrel laminate when the bat is subjected to rolling—and thus creates multiple failure zones or failure planes—because the stiffening ribs limit localized barrel deflection.

In one embodiment, the one or more voids 70, 74 may be filled with one or more materials that can withstand impacts associated with normal bat use. For example, balsa wood, rigid urethane foam, fiber glass and epoxy, injection-molded polyphenylene sulphide, acrylonitrile butadiene styrene, polycarbonate, or other suitable materials may fill the one or more voids 70, 74.

In another embodiment, weak rings or ribs may be included in the barrel laminate to create additional failure planes. For example, materials that do not bond strongly to the surrounding barrel laminate, such as nylon or polytetrafluoroethylene, may be used as rings or void-filling materials that would readily break down when the barrel is subjected to deflections resulting from rolling. Alternatively, materials weaker than the surrounding barrel laminate, such as low-strain fibers having an elongation of less than 1.4%, high modulus polypropylene fibers, carbon coated with a release agent, and so forth could be used to create a weak ring or rib, or a generally weakened region.

The ball bats described herein may be designed to perform at or very close to established regulatory limits, since multi-plane failure within a barrel wall causes a rapid decrease in barrel performance (with no temporary increase in performance). Many existing bats, conversely, must initially perform well below regulatory limits, since failure in these bats often leads to a temporary increase in barrel performance.

The various embodiments described herein also provide a great deal of design flexibility. For example, in a double-wall ball bat, one or more additional failure planes could be included in the outer barrel wall, or in the inner barrel wall, or in both walls. Furthermore, the various described embodiments may optionally be used in combination with one another. For example, a ball bat may include a first additional failure plane created by extreme fiber angle variations between neighboring composite plies, and a second additional failure plane created by a perforated partial barrier layer or a gap in the barrel laminate. The total number of failure planes provided within a given barrel wall may be varied, as well. Thus, as barrel performance standards change over time, those skilled in the art will be able to modify composite bat performance to meet those standards by including a variety of failure planes in the bat barrel.

Accordingly, the preferred fiber angles, perforation percentages, locations of gaps, rings, or ribs, and so forth described herein may be modified depending on the design goals for a given bat and on the overall bat construction. For example, in a given bat, the specific materials used, the thickness of the composite plies, the amount of deflection prescribed by a given test or at which the bat is intended to fail (for example, 0.10 inches or 0.20 inches of deflection), the number and locations of failure planes provided, and so forth could dictate that the described values be modified. Those skilled in the art will appreciate how to modify the design of the ball bat to account for these variations.

Any of the above-described embodiments may be used alone or in combination with one another. Furthermore, the ball bat may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a barrel comprising a composite laminate, wherein the barrel includes an external surface and an internal surface, such that a neutral axis defining a primary failure plane is located between the external and internal surfaces;

a discontinuity within the composite laminate comprising a void bordered by at least one protrusion, the discontinuity creating an additional failure zone; and a handle attached to or integral with the barrel.

2. The ball bat of claim 1 further comprising a tapered region between the barrel and the handle, wherein the discontinuity is located closer to the tapered section than to a sweet spot of the barrel.

3. The ball bat of claim 1 further comprising an additional discontinuity, creating another additional failure zone, near the internal surface of the barrel.

4. The ball bat of claim 1 further comprising another additional failure zone created by extreme variations in fiber angles in neighboring composite plies.

5. The ball bat of claim 1 wherein the void is filled with at least one material selected from the group consisting of balsa wood, rigid urethane foam, fiber glass and epoxy, injection-molded polyphenylene sulphide, acrylonitrile butadiene styrene, and polycarbonate.

6. The ball bat of claim 1 wherein the protrusion comprises portions of the composite laminate shifted off of a longitudinal axis of the ball bat.

7. The ball bat of claim 1 wherein the void is bordered by a first protrusion extending toward an exterior of the ball bat, and a second protrusion extending toward an interior of the ball bat.

* * * * *